United States Patent [19]

Tsuji et al.

[11] Patent Number: 4,908,158

[45] Date of Patent: Mar. 13, 1990

[54] ELECTRICAL CONTACT MATERIAL AND METHOD OF PREPARING SAME

[75] Inventors: Koji Tsuji, Nara; Shuji Yamada, Ashiya; Yoshinobu Takegawa, Nara, all of Japan

[73] Assignee: Matsushita Electric Works, Ltd., Osaka, Japan

[21] Appl. No.: 309,982

[22] Filed: Feb. 13, 1989

Related U.S. Application Data

[63] Continuation of Ser. No. 88,225, Aug. 24, 1987, abandoned.

[30] Foreign Application Priority Data

Aug. 26, 1986 [JP] Japan ..... 61-199744

[51] Int. Cl.[4] ..... H01B 1/06

[52] U.S. Cl. ..... 252/514; 252/518; 252/519; 252/513; 75/247; 75/234; 75/235; 200/265

[58] Field of Search ..... 252/514, 518, 513, 519; 200/265, 266; 75/232, 234, 235, 247

[56] References Cited

U.S. PATENT DOCUMENTS

| | | | |
|---|---|---|---|
| 3,859,087 | 1/1975 | Bachstrom | 252/514 |
| 3,893,821 | 7/1975 | Davies et al. | 252/514 |
| 3,913,201 | 10/1975 | Schreiner et al. | 252/514 |
| 3,930,849 | 1/1976 | Krock et al. | 129/182.5 |
| 3,954,459 | 5/1976 | Schreiner et al. | 252/514 X |
| 3,957,453 | 5/1976 | Hässler et al. | 29/182.1 |
| 4,141,727 | 2/1979 | Shida et al. | 200/265 |
| 4,204,863 | 5/1980 | Scheiner | 252/514 |
| 4,341,556 | 7/1982 | Bohm et al. | 200/266 |
| 4,565,590 | 1/1986 | Grosse et al. | 75/234 |

*Primary Examiner*—Josephine Barr

*Attorney, Agent, or Firm*—Burns, Doane, Swecker & Mathis

[57] ABSTRACT

An electrical contact material consists of Ag in which a metallic oxide is produced and dispersed through an internal oxidation and containing as metallic elements Cd, Mn and Al. With this contact material of this composition, there can be shown a high anti-welding property and a stably low contact resistance.

3 Claims, 2 Drawing Sheets

ELECTRICAL CONTACT MATERIAL AND METHOD OF PREPARING SAME

This is a continuation of Ser. No. 088,225, filed 8/24/87, now abandoned.

TECHNICAL BACKGROUND OF THE INVENTION

This invention relates to an electrical contact material and a method of preparing the same. More particularly, it relates to a contact material in which a metallic oxide produced by means of an internal oxidation is dispersed in Ag and to a method of preparing such materials.

The metallic contact materials of the kind referred to can be effectively utilized for making contacts of such electromagnetic contact devices as relays, magnet contacts, circuit breakers and the like, by improving the materials in their anti-welding property.

1. Disclosure of Prior Art

There have been suggested various types of the contact materials for use in the electromagnetic contact devices. For these contact materials, it has been demanded that such three features as the wear resistance, anti-welding property and low contact resistance are concurrently realized to a high level, but it is considered to be extremely difficult to provide a contact material which satisfies concurrently these three features in practice. On the other hand, such contactor devices as the relays are often employed in circuits or devices for controlling any input and output, in which event an inrush current is apt to occur in the input and output circuits, and, accordingly, it has been demanded for the contact material the anti-welding property can be realized to a high level so that no welding will take place even upon occurrence of the inrush current.

As the contact material for the electromagnetic contact devices, generally, Ag-CdO materials, Ag-SnO materials have been employed. While contacts of the Ag-CdO materials have been widely employed as a good material which showing a stable low contact resistance because CdO as an oxide is caused to sublime due to arc heat upon opening and closing operations of the contacts so as not to cause any heap up of the oxide produce on the contactor surfaces, they still have not been sufficiently satisfactory in the level of the anti-welding property with respect to the inrush current. Contacts of Ag-SnO have been excellent as compared with the Ag-CdO materials in the anti-welding property, but these materials have involved a problem that the low contact resistance cannot be stably obtained.

In U.S. Pat. No. 3,880,777,Akira SHIBATA has suggested a contact material which consisting of Ag containing at least two of Zn, Sn and Sb as well as one of Group IIa elements in the Periodic Table added along with Ni or Co, in attempt to have the contact material provided with both the anti-welding property and low contact resistance, but this contact material still has been defective in the level of the both characteristics obtained.

2. Technical Field

A primary object of the present invention is, therefore, to provide a contact material of Ag-CdO system produced by means of the internal oxidation, which shows a sufficiently excellent anti-welding property, stably low contact resistance and high wear resistance, and a method of preparing such a contact material.

According to the present invention, the above object can be attained by providing a contact material in which CdO or the like metallic oxide produced by means of the internal oxidation within Ag is dispersed, wherein Mn and Al are further contained as metal elements for the metallic oxide.

Other objects and advantages of the invention shall be made clear in following description of the invention detailed with reference to working aspects thereof.

While the present invention now be described with reference to certain embodiments as in the followings, it should be appreciated that the intention is not to limit the invention only to these embodiments but rather to include all alterations, modifications and equivalent arrangement possible within the scope of appended claims.

Referring to a term "thermo-hardness coefficient" employed in the following disclosure, it should be noted that the term represents an absolute value of A/B in which A is the hardness at 0° K. and B is the softening factor at measuring temperature of the contact material, and it is meant that larger the A/B value, more excellent the anti-welding property.

DISCLOSURE OF PREFERRED EMBODIMENTS

Figure 1:
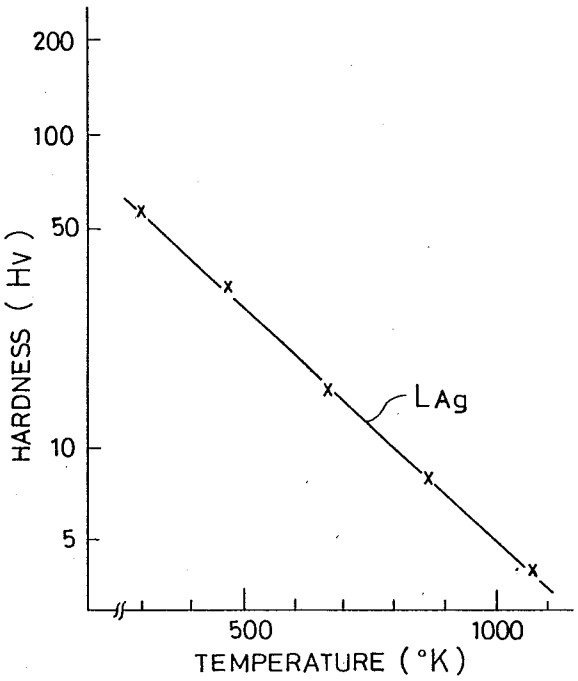
FIG. 1 shows graphically the relationship between the temperature and the hardness of Ag which forming a basic member of the contact material of the present invention.

In developing the contact material of the present invention, it has been specifically noted that a correlativity exists between the thermo-hardness coefficient and the anti-welding property. In obtaining the thermo-hardness coefficient A/B of Ag, an Ag sample is placed in, e.g., an argon gas atmosphere under an application of load of 1 kg$\times$15 sec., and the hardness (Hv) at a variety of temperatures is measured by means of a high-temperature micro-Vickers hardness meter, whereby a line $L_{Ag}$ as in FIG. 1 is obtained. That is, this line $L_{Ag}$ is represented by $H=\exp(-BT)$, in which T is the temperature (°K.) and H is the hardness at the temperature T. When A is of a value of 159.5 while B is $-0.0034$, then the thermo-hardness coefficient would be $4.6 \times 104$, and the unit of value calculated with this coefficient employed will be $kg.mm^{-2}$.

Figure 2:
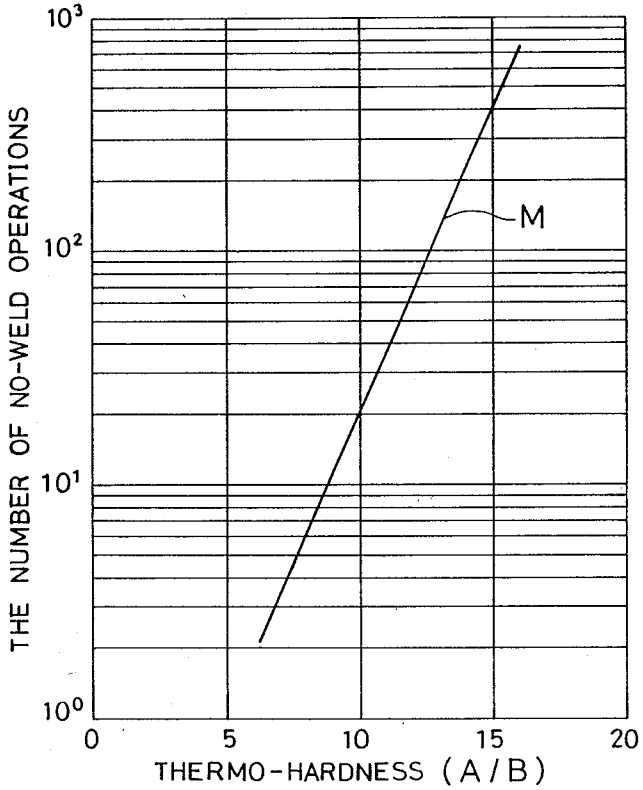
FIG. 2 shows diagrammatically the relationship between the thermo-hardness coefficient (A/B) and the number of no-weld operation or the number of ON and OFF operation achieved until contacts are welded together.

Further, it has been discovered that the thermo-hardness coefficient has a correlativity to the number of ON and OFF operations of the contacts until their contact material is fused to weld them together, which is such a positive correlation as shown by a straight line M of FIG. 2 with respect to the number of contact ON/OFF operation (no-weld operation) when the contact material is used as, for example, a capacitive load of a peak current Ip of 1 KA. In preparing the diagram of FIG. 2, the number of contact ON/OFF operation is based on an estimate ($\hat{\mu}$) by means of Weibull distribution, which estimate can be obtained through a following equation:

$$\hat{\mu}=0.047\times\exp(6.10\times10^{-5}\times A/B)$$

It has been also discovered through a keen research conducted by the present inventors that the thermo-hardness coefficient A/B can be elevated by rendering the metallic oxide microfinely divided within the contact material and a higher level anti-welding property can be thereby attained, and that, for the purpose of microfinely dividing the metallic oxide, the contact material of Ag-CdO system produced by means of the internal oxidation should contain Mn and Al in the form of the metallic oxide.

It has been also found that the metallic elements forming the metallic oxide should be of such contents that Cd is be in a range of 1 to 20 wt %, preferably in a range of 8 to 12 wt %, since with Cd below 1 wt % the non-welding property and wear resistance are both deteriorated to be insufficient while Cd exceeding 20 wt % the internal oxidation within Ag becomes difficult or a problem of lowering the workability is likely to arise, that Mn be in range of 0.001 to 0.2 wt %, preferably in a range of 0.004 to 0.05 wt %, since with Mn less than 0.001 wt % the effect of the microfine division or grain refining of the metallic oxide is lowered while Mn exceeding 0.2 wt % renders the oxide's condensation remarkable at grain boundary to cause the hot extrusion become uneasy and thus the workability deteriorated, and that Al be in a range of 0.001 to 0.2 wt %, preferably in a range of 0.004 to 0.05 wt %, since Al less than 0.001 wt % lowers the effect of the oxide's grain refining while Al exceeding 0.2 wt % results also in the remarkable condensation of the oxides at the grain boundary to have the workability deteriorated for the same reason in the case of Mn.

In the above, the grain refining effect for the metallic oxide cannot be sufficiently improved by an addition of only one of Mn and Al but can be remarkably improved only when both of Mn and Al are concurrently contained.

It has been additionally found to be optimum that, for the purpose of micro-refining the crystal grain of Ag matrix, at least one of Fe group elements, i.e., Fe, Ni and Co is contained in a range of 0.05 to 0.5 wt % so that the particular Fe group elements will act to restrain the crystal grain growth to precipitate at the crystal grain boundary of the internal oxidation. It has been also found that, with the Fe group element contained presumably less than 0.05 wt %, the crystal grain refining effect is lowered while the element exceeding 0.5 wt % results in a segregation to cause the conductivity and workability deteriorated.

EXAMPLE 1

As indicated on the line of EXAMPLE 1 in TABLE I as in the following, the respective metal materials were weighed so that Cd would be 12.0 wt %, Mn be 0.004 wt %, Al be 0.006 wt % and the rest be all Ag, these materials were melted by means of a high-frequency furnace within an atmosphere of argon gas and cast into a metal mold and an ingot of them was obtained. This ingot was then heated within an argon gas atmosphere to be annealed, subjected to a hot-rolling and thereafter to the internal oxidation with a heating at a temperature 600° C. within an oxygen atmosphere for about 100 hours, and a plane-shaped contact material was obtained.

EXAMPLES 2-11

In accordance with indications on lines of EXAMPLES 2 to 10 in TABLE I, respective metal materials were weighed and processed through the same treating steps as in EXAMPLE 1 to obtain ingots of such compositions as indicated, respectively, and plate-shaped contact materials were obtained.

COMPARATIVE EXAMPLES 1-4

To obtain ingots of such compositions as indicated on lines of COMPARATIVE EXAMPLES 1-4 in TABLE I, the respective metal materials were weighed in accordance with the indications, thus obtained ingots were processed in the same manner as in EXAMPLE 1, and plate-shaped contact materials for comparison purpose were obtained.

With part of the respective plate-shaped contact materials thus obtained through EXAMPLES 1 through 11 and COMPARATIVE EXAMPLES 1 through 4 employed as samples, measurement of the thermo-hardness was carried out by means of the high temperature micro-Vickers hardness meter, their A/B values were obtained from the measurements, and the values were also presented in TABLE I. Grain size of the metallic oxide produced in the respective samples was electron-microscopically measured and also shown in TABLE I.

TABLE I

| | Ingot Composition (wt %) | | | | | | | A/B | Grain Size |
|---|---|---|---|---|---|---|---|---|---|
| | Cd | Mn | Al | Fe | Ni | Co | Ag | ($\times10^4$) | ($\mu$m) |
| EXAMPLE | | | | | | | | | |
| 1 | 12.0 | .004 | .006 | — | — | — | Rest | 16.4 | 0.2 |
| 2 | 12.0 | .010 | .005 | — | — | — | " | 17.7 | 0.2 |
| 3 | 12.0 | .010 | .010 | — | — | — | " | 18.0 | 0.2 |
| 4 | 12.0 | .050 | .050 | — | — | — | " | 17.2 | 0.2 |
| 5 | 12.0 | .100 | .100 | — | — | — | " | 16.3 | 0.3 |
| 6 | 12.0 | .200 | .200 | — | — | — | " | 12.5 | 0.5 |
| 7 | 1.0 | .001 | .001 | — | .050 | — | " | 12.3 | — |
| 8 | 12.0 | .005 | .010 | .050 | — | — | " | 15.2 | 0.2 |
| 9 | 10.0 | .050 | .100 | — | — | .100 | " | 14.5 | 0.2 |
| 10 | 8.0 | .030 | .050 | — | — | — | " | 12.5 | — |
| 11 | 20.0 | .004 | .004 | — | — | — | " | 13.0 | — |
| COMP. EX. | | | | | | | | | |
| 1 | 12.0 | — | — | — | — | — | " | 11.1 | 0.5 |
| 2 | 12.0 | .200 | — | — | — | — | " | 11.2 | 0.5 |
| 3 | 12.0 | — | .200 | — | — | — | " | 11.7 | 0.4 |
| 4 | 12.0 | .600 | .600 | — | — | — | " | 11.5 | non- |

TABLE I-continued

| Ingot Composition (wt %) | | | | | | | A/B Grain Size | |
|---|---|---|---|---|---|---|---|---|
| Cd | Mn | Al | Fe | Ni | Co | Ag | ($\times 10^4$) | ($\mu$m) |
| | | | | | | | | uniform |

Figure 3:
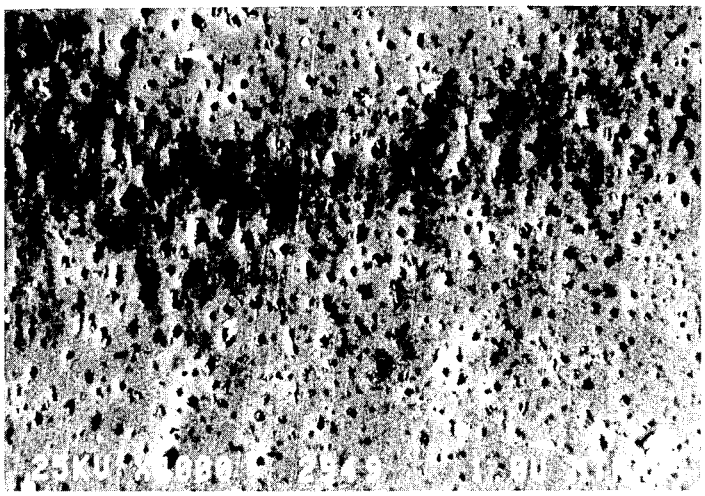
FIG. 3 is an electron-microscopic photograph also of a metal structure of one of the contact materials according to the present invention, in which a metallic oxide containing Cd of 12.0 wt %, Mn of 0.004 wt % and Al of 0.006 wt % is dispersed in Ag.
Figure 4:
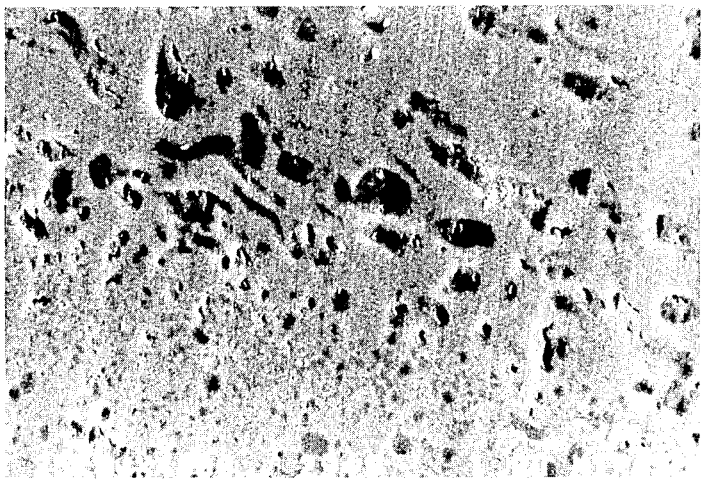
Fig. 4 (PRIOR ART)
FIG. 4 is an electron-microscopic photograph of a metal structure of a known contact material in which Cd of 12.0 wt % is dispersed in Ag.

As will be clear in view of the above TABLE I, it should be appreciated that, according to the contact material of the respective EXAMPLES of the present invention, a remarkable improvement is achieved in the A/B value, that is, the thermo-hardness characteristics, as compared with the material of COMPARATIVE EXAMPLES. When the electron-microscopic photograph of FIG. 3 which shows the metal structure of the contact material according to EXAMPLE 1 of TABLE I is compared with other similar photograph of FIG. 4 of the material according to COMPARATIVE EXAMPLE 1, it should be also appreciated that the grain refining effect is sufficiently achieved in the metallic oxide of the material of the present invention.

In employing the contact material of the present invention in the contacts of such mass-producible device as relays, it is preferable mainly from the view point of economy that the material is prepared by utilizing a preoxidation for allowing a cold press bonding of the material with copper to be achievable. In that event, raw metallic materials for obtaining an ingot of, for example, EXAMPLE 1 composition are melted, mixed and molded through the same steps as in EXAMPLE 1, preferably. Thus obtained ingot is then extrusion-molded into a wire of a diameter of 2 mm, which wire is cut into short pieces of, for example, about 5 mm length. Thereafter, such short wire pieces are subjected to the internal oxidation through the same steps as in, for example, EXAMPLE 1, a proper number of which wire pieces are then pressed and formed into billets which are, for example, of a diameter of 100–150 mm $\phi$ and a length of about 100 mm, and such billets are sintered. By repeating the pressing and sintering, for example, two or three times, it is possible to elevate the density of the contact material. When a desired density of the material is reached, the material is subjected to a hot extrusion to be formed into a wire of a diameter of about 6 mm, and the wire is thereafter subjected to a drawing repeatedly by means of a die until the desired diameter is reached, and the contacts of, for example, a rivet shape may be obtained from the drawn contact material.

With respect to the contact material prepared to be of the composition of EXAMPLE 1 through the same steps as thereof and another contact material of the composition of COMPARATIVE EXAMPLE 1 also through the same steps, two different tests which are ASTM test as a standard contact testing measure as well as a test of characteristics in a state of being assembled in a relay have been carried out.

For the former ASTM test, 12 tests were carried out employing these contact materials used as connected to a load of 100 v and 20 A in the steady current and 118 A in the inrush current, and ON/OFF operation was carried out 10,000 time. The number of such operation achieved until an occurrence of initial stage welding is plotted on the basis of the Weibull distribution to obtain the anti-welding property at a reliability $\rho_{90}$ of 90%. The wear resistance was obtained in the form of an average value of variation in weight before and after the test.

For the latter test, practically, TV-8 test as well as horsepower rating test were carried out for evaluating the anti-welding property, and also AC-1 test was performed in practice to evaluate the contact resistance, ON/OFF load conditions upon which were set as in following TABLE II;

TABLE II

| | TV-8 | Horsepower Rating | AC-1 |
|---|---|---|---|
| Number of Relays Used for Test | 6 | 6 | 3 |
| Overload | AC 100 V 163 A Rush<br>Steady 12 A<br>Contact Operated 50 times | AC 220 V 60 A Cos $\phi$ = 0.4<br>Contact Operated 50 times | — |
| Dure | AC 100 A 117 A Rush<br>Steady 12 A<br>Contact Operated 25,000 times | AC 125 V 20 A Cos $\phi$ = 0.4<br>Contact Operated 30,000 times | 250 V 15 A<br>Contact Operated 100,000 times |

In measuring the contact resistance of AC-1, average values of 1 to 1,000 times and 100,000 to 101,000 times of the contact ON/OFF operation were obtained.

Results of the two different tests made with respect to the contact materials of EXAMPLE 1 and COMPARATIVE EXAMPLE 1 are as shown in following TABLE III:

TABLE III

| Property | Type of Test | EXAMPLE 1 | COMP. EX. 1 |
|---|---|---|---|
| Welding | ASTM | 13 | 3.3 |
| | TV-8 - Overload | All 6 | All 6 |
| | Dure | excellent | excellent |
| | HP Rating - Overload | All 6 | 2 welded |
| | Dure | excellent | 4 excellent |
| Contact Resistance (m$\Omega$) | AC-1 1–1000 times | 3.6 | 7.7 |
| | 100,000–101,000 times | 3.7 | 5.7 |
| Wear Resistance (mg) | ASTM | 0.4 | 0.6 |

In view of the above test results, it should be appreciated that the contact material according to the present invention could have been improved to a larger extent in all three properties of the anti-welding property, low contact resistance and wear resistance.

What we claim as our invention is:

1. A contact material comprising: an Ag matrix and a metallic oxide of Cd, Mn, and Al wherein said oxide is produced and dispersed in said Ag matrix by internal oxidation and wherein said metallic oxide contains Cd of 1 to 20 wt %, Mn of 0.001 to 0.2 wt % and Al of 0.001 to 0.2 wt %.

2. A contact material according to claim 1, further comprising at least one Fe group element selected from the group consisting of Fe, Ni and Co in an amount of from about 0.05 to 0.5 wt %.

3. A contact material according to claim 1, wherein Cd is 8.0 to 12.0 wt %, Mn is 0.004 to 0.05 wt % and Al is 0.004 to 0.05 wt %.

* * * * *